US010979802B2

(12) United States Patent
Chen et al.

(10) Patent No.: US 10,979,802 B2
(45) Date of Patent: Apr. 13, 2021

(54) SPEAKER MODULE

(71) Applicant: AAC Technologies Pte. Ltd., Singapore (SG)

(72) Inventors: Zhichen Chen, Shenzhen (CN); Wei Wei, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/525,583

(22) Filed: Jul. 30, 2019

(65) Prior Publication Data

US 2020/0045410 A1 Feb. 6, 2020

(30) Foreign Application Priority Data

Aug. 3, 2018 (CN) ..... 201821246234.4

(51) Int. Cl.
*H04R 1/28* (2006.01)

(52) U.S. Cl.
CPC ..... *H04R 1/288* (2013.01)

(58) Field of Classification Search
CPC . H04R 1/00; H04R 1/02; H04R 1/021; H04R 1/06; H04R 1/28; H04R 1/22; H04R 1/20; H04R 1/2803; H04R 1/2807; H04R 1/2811; H04R 1/2823; H04R 1/2815; H04R 1/2838; H04R 1/2846; H04R 1/2849; H04R 1/2869; H04R 1/2873; H04R 1/2876; H04R 1/288; H04R 1/2844; H04R 1/2888; H04R 1/2892; H04R 1/2896; H04R 2101/00; H04R 1/029; H04R 2499/11; H04R 2205/021
See application file for complete search history.

(56) References Cited

U.S. PATENT DOCUMENTS 6,932,187 B2 * 8/2005 Banter ..... H04R 1/023 181/149
2015/0382100 A1 * 12/2015 Azmi ..... H04R 1/2811 381/380
2018/0255393 A1 * 9/2018 Wang ..... H04R 1/025

FOREIGN PATENT DOCUMENTS

CN 206542568 U * 10/2017 ..... H04R 1/021
CN 108124225 A * 6/2018 ..... H04R 1/021

* cited by examiner

*Primary Examiner* — Walter F Briney, III
(74) *Attorney, Agent, or Firm* — W&G Law Group LLP

(57) ABSTRACT

In the present disclosure, a speaker module includes a housing having an accommodating space and a speaker unit accommodated in the accommodating space. The housing includes a bottom wall, a top wall opposite the bottom wall, and a side wall extending from the bottom wall toward the top wall. The speaker module further includes at least one isolating member connected to the top wall and the bottom wall respectively. The isolating member isolates the accommodating space into an accommodating cavity that accommodates the speaker unit and a filling cavity that accommodates a sound-absorbing material. The isolating member includes an isolating frame, a sound-absorbing foam attached to the isolating frame, and a hot melt adhesive layer disposed between the sound-absorbing foam and the isolating frame. The sound-absorbing foam extends beyond an edge of the isolating frame.

9 Claims, 4 Drawing Sheets

SPEAKER MODULE

TECHNICAL FIELD

The present disclosure relates to electroacoustic conversion technology, and particularly relates to a speaker module.

BACKGROUND

With an advent of a mobile Internet era, a time for updating electronic products becomes shorter and shorter, and requirements on performance of electronic products in various aspects are becoming higher and higher, for example, on high-quality music function. Therefore, the performance of electroacoustic systems needs to be continuously improved. Thus, a high-quality speaker module is one of essential conditions for a high-quality music function.

A DBASS polymer nanometer sound amplification technology based on excellent sound effect thereof has been widely used in various electronic products. Currently, during a process of manufacturing a speaker module using a DBASS process, DBASS polymer nanometer powder is generally filled into a specific area of a housing firstly, and a mesh is disposed to block the filling polymer nanometer powder, and then a speaker unit is installed. However, as a shape of the injection area is limited by different installation environments, amount of polymer nanometer powder to be filled cannot be ensured, thereby affecting sound amplification effect of products.

Therefore, it is necessary to provide a new speaker module to solve the above-described problem.

DETAILED DESCRIPTION

The present disclosure is further described with reference to accompanying drawings.

Figure 1:
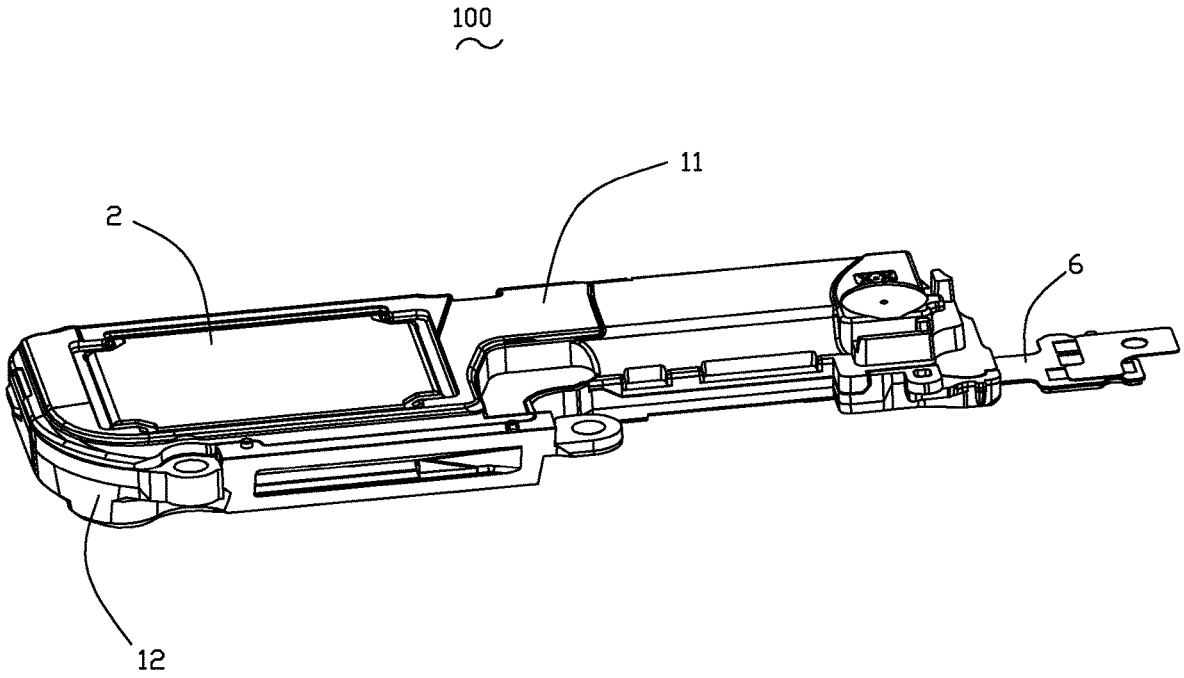
FIG. 1 is a perspective view of a speaker module in the present disclosure.
Figure 2:
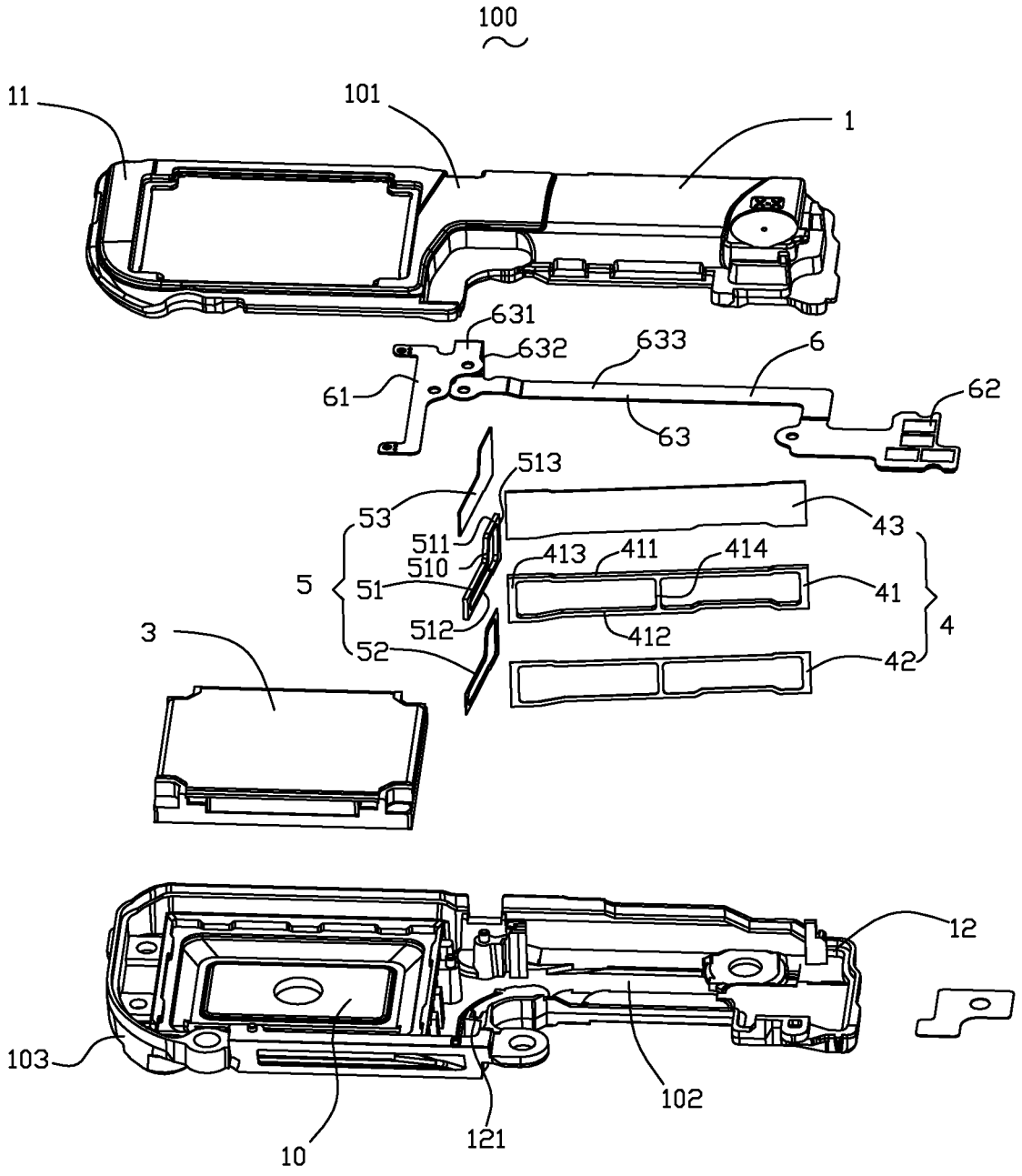
FIG. 2 is a schematic exploded structural view of the speaker module in the present disclosure.

As shown in FIG. 1 and FIG. 2, the present disclosure provides a speaker module 100 which includes a housing 1 having an accommodating space and a speaker unit 2 accommodated in the housing.

The housing 1 includes an upper housing 11 having a top wall 101 and a lower housing 12 having a bottom wall 102. At least one of the upper housing 11 and the lower housing 12 has a side wall 103 that is bent and extends. The side wall 103, the top wall 101 and the bottom wall 102 define an accommodating space. The side walls 103 may be in a regular shape with sides parallel to each other, or may be an irregular structure.

The accommodating space includes an accommodating cavity 10 that accommodates the speaker unit 2 and a filling cavity 20 that accommodates a filling material. A filling material in the filled cavity 20 is a sound-absorbing material. Specifically, a powder filling process is used in the present disclosure, i.e., sound-absorbing polymer particles are filled into the filling cavity 20.

Figure 3:
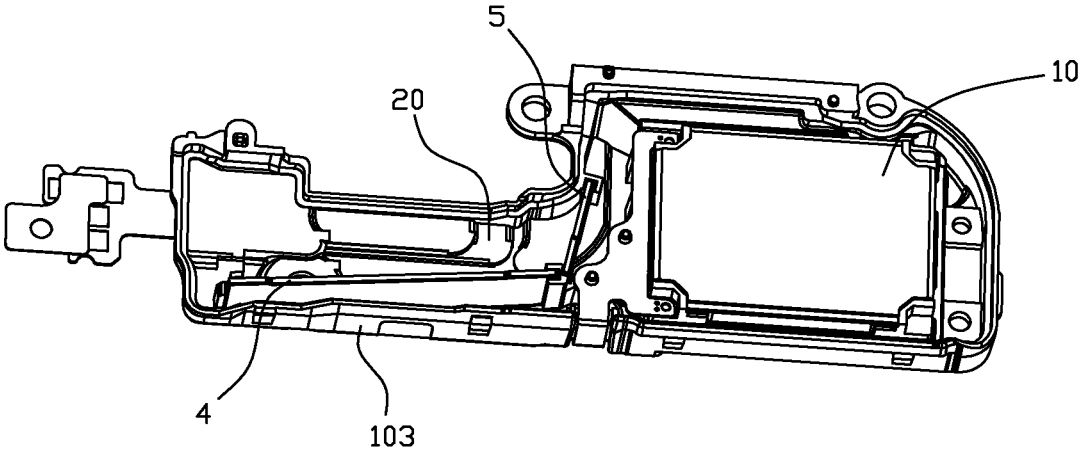
FIG. 3 is a schematic partial assembled structural view of the speaker module in the present disclosure.
Figure 4:
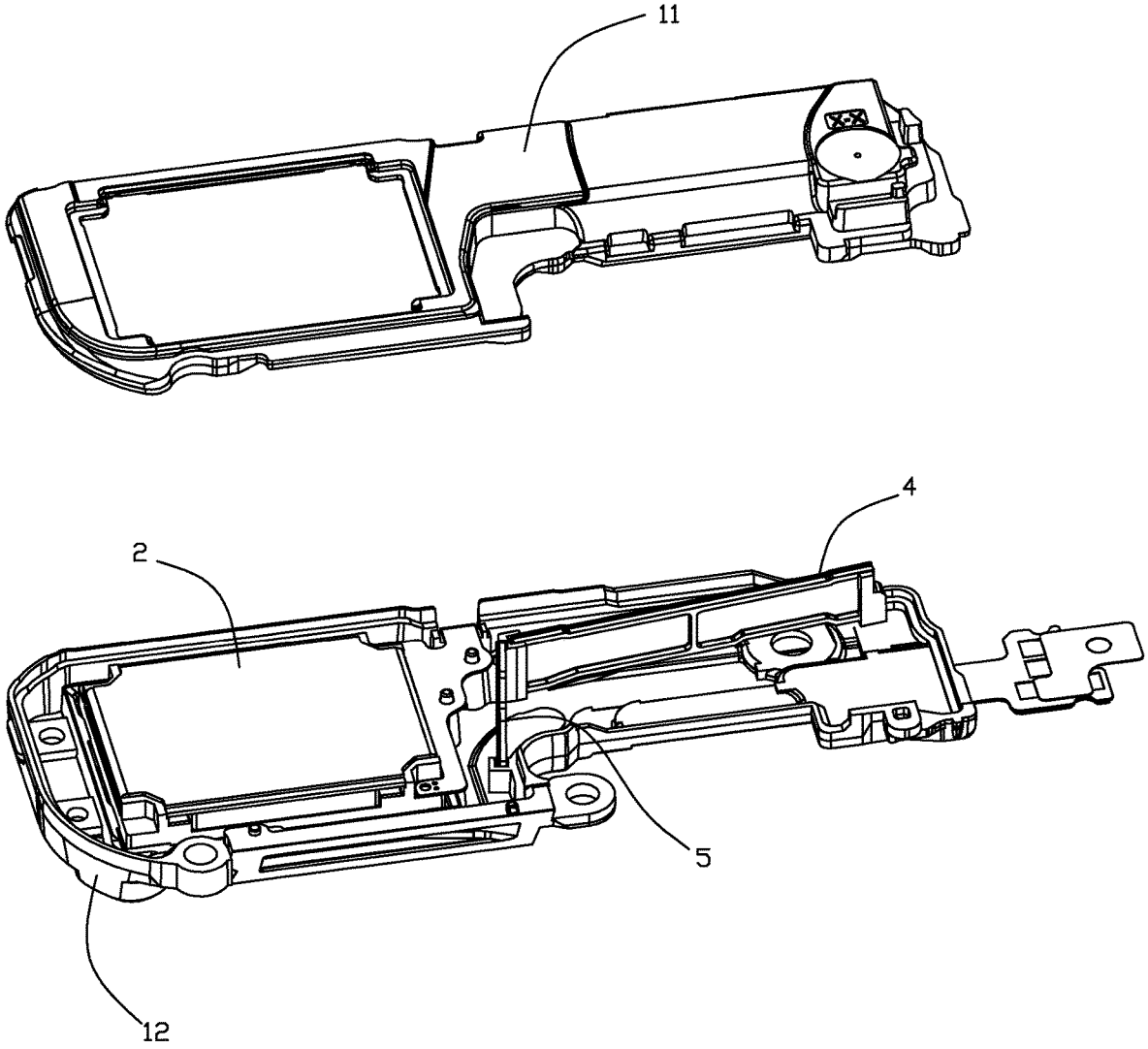
FIG. 4 is a schematic partial exploded structural view of the speaker module in the present disclosure.

With reference to FIG. 3 and FIG. 4, the speaker module is further disposed with an isolating member that isolates the accommodating cavity 10 that accommodates the speaker unit 2 from the filling cavity 20. The isolating member includes a first isolating member 4 and a second isolating member 5 that are disposed in an interlaced manner. The first isolating member 4, the second isolating member 5 and the housing define the filling cavity 20.

The isolating member includes an isolating frame, a sound-absorbing foam attached to the isolating frame, and an adhesive layer disposed between the sound-absorbing foam and the isolating frame. Specifically, in this embodiment, the first isolating member 4 includes a first isolating frame 41, a sound-absorbing foam 42 attached to the first isolating frame 41, and a hot melt adhesive layer 43 disposed between the first isolating frame 41 and the sound-absorbing foam 42. The second isolating member 5 includes a second isolating frame 51, a sound-absorbing foam 52 attached to the second isolating frame 51, and a hot melt adhesive layer 53 disposed between the second isolating frame 51 and the sound-absorbing foam 52. The isolating frame is a stainless steel support made of a stainless steel structure. An outer edge of the sound-absorbing foam is beyond an outer edge of the isolating frame. The sound-absorbing foam with compressibility may be compressed to reduce risk of powder leakage, thus having buffering, sealing and cushioning functions.

The first isolating member 4 and the second isolating member 5 may be identical or different in terms of structure. In this embodiment, specifically, the first isolating frame 41 includes a first upper border 411 close to the top wall 101, a first lower border 412 close to the bottom wall 102, and a first side border 413 and a middle border 414 that connect the first upper border 411 and the first lower border 412.

The second isolating frame 51 of the second isolating member 5 includes a second upper border 511, a second lower border 512, and a second side border 513 connecting the second upper border 511 and the second lower border 512.

The speaker module further includes a FPCB (flexible printed circuit board) 6 configured to realize electrical connection. The flexible printed circuit 6 includes a first conductive terminal 61 connected to the speaker unit, a second conductive terminal 62 electrically connected to an external circuit, and a connecting portion 63 connecting the first conductive terminal 61 and the second conductive terminal 62. The connecting portion 63 includes a first connecting portion 631 connected to the first conductive terminal 61, a second connecting portion 632 bent and extending from the first connecting portion 631, and a third connecting portion 633 bent and extending from the second connecting portion 632. The second connecting portion 632 is attached to the side wall 103 of the housing and the third connecting portion 633 is attached to the bottom wall 102 of the housing. The second isolating member 5 is disposed with an avoiding portion 510 that avoids the first connecting portion 631. Specifically, the avoiding portion 510 is formed by denting the second upper border 511 towards the second lower border 512.

Further, the bottom wall 102 is disposed with a slot 121 protruding towards the top wall 101, and two ends of the first isolating member 4 and the second isolating member 5 are respectively inserted into the slot in order to position the isolating members.

Using the above-described structure, the accommodating cavity 10 that accommodates the speaker unit 2 may be isolated from the filling cavity 20. Therefore, sufficient DBASS polymer nanometer powder may be filled into the filling cavity 20, thereby not affecting performance of the speaker unit and making full use of space.

In the present disclosure, a speaker module includes a housing having an accommodating space and a speaker unit accommodated in the accommodating space. The housing includes a bottom wall, a top wall opposite the bottom wall, and a side wall extending from the bottom wall toward the top wall. The speaker module further includes at least one isolating member connected to the top wall and the bottom wall respectively. The isolating member isolates the accommodating space into an accommodating cavity that accommodates the speaker unit and a filling cavity that accommodates a sound-absorbing material. The isolating member includes an isolating frame, a sound-absorbing foam attached to the isolating frame, and a hot melt adhesive layer disposed between the sound-absorbing foam and the isolating frame. The sound-absorbing foam extends beyond an edge of the isolating frame. With respect to a speaker module in this disclosure, an isolating member is provided to isolate an accommodating space into at least two parts, and a filling cavity is sealed and isolated from a speaker unit. Therefore, the entire filling cavity may be filled with a filling material. In this way, space is fully used, a sound amplification function is achieved, and product performance is improved.

Although embodiments of the present disclosure are presented and described above, it should be understood that the embodiments are exemplary rather than limit the present disclosure. Change, modification, substitution and variation may be made to the above-described embodiments by those skilled in the art within the scope of the present disclosure.

What is claimed is:

1. A speaker module, comprising a housing having an accommodating space and a speaker unit accommodated in the accommodating space, wherein the housing comprises a bottom wall, a top wall opposite the bottom wall, and a side wall extending from the bottom wall towards the top wall, wherein the speaker module further comprises at least one isolating member connected to the top wall and the bottom wall respectively, the isolating member isolates the accommodating space into an accommodating cavity that accommodates the speaker unit and a filling cavity that accommodates a sound-absorbing material, and the isolating member comprises an isolating frame, a sound-absorbing foam attached to the isolating frame, and a hot melt adhesive layer disposed between the sound-absorbing foam and the isolating frame, wherein the sound-absorbing foam extends beyond an outer edge of the isolating frame.

2. The speaker module according to claim 1, wherein the isolating frame is a stainless steel support.

3. The speaker module according to claim 1, wherein the isolating member comprises a first isolating member and a second isolating member that are disposed in an interlaced manner and the first isolating member, the second isolating member and the housing define the filling cavity.

4. The speaker module according to claim 3, wherein the speaker module further comprises a flexible printed circuit board electrically connected to the speaker unit, the flexible printed circuit board comprises a first conductive terminal connected to the speaker unit, a second conductive terminal electrically connected to an external circuit, and a connecting portion connecting the first conductive terminal and the second conductive terminal.

5. The speaker module according to claim 4, wherein the connecting portion comprises a first connecting portion connected to the first conductive terminal, a second connecting portion bent and extending from the first connecting portion, and a third connecting portion bent and extending from the second connecting portion, the second connecting portion is attached to the side wall of the housing and the third connecting portion is attached to the bottom wall of the housing.

6. The speaker module according to claim 5, wherein the second isolating member is disposed with an avoiding portion that avoids the first connecting portion.

7. The speaker module according to claim 3, wherein the first isolating member comprises the first isolating frame, and the first isolating frame comprises a first upper border close to the top wall, a first lower border close to the bottom wall, and a first side border and a middle border that connect the first upper border and the first lower border.

8. The speaker module according to claim 6, wherein the second isolating member comprises a second upper border, a second lower border, and a second side border connecting the second upper border and the second lower border, and the avoiding portion is formed by denting the second upper border towards the second lower border.

9. The speaker module according to claim 1, wherein the bottom wall is disposed with a slot protruding towards the top wall, and two ends of the isolating member are respectively inserted into the slot.

* * * * *